US006105374A

United States Patent [19]

Kamody

[11] Patent Number: 6,105,374

[45] Date of Patent: Aug. 22, 2000

[54] PROCESS OF NITRIDING METAL-CONTAINING MATERIALS

[75] Inventor: Dennis J. Kamody, New Kensignton, Pa.

[73] Assignee: Nu-Bit, Inc., New Kensington, Pa.

[21] Appl. No.: 09/123,489

[22] Filed: Jul. 28, 1998

[51] Int. Cl.[7] ..... F25D 17/02

[52] U.S. Cl. ..... 62/64; 62/65; 62/78; 148/577

[58] Field of Search ..... 62/62, 64, 78, 62/65; 148/577, 578

[56] References Cited

U.S. PATENT DOCUMENTS 3,891,477 6/1975 Lance et al. ..... 62/64

4,482,005 11/1984 Voorhees ..... 62/64

4,739,622 4/1988 Smith ..... 62/78

5,259,200 11/1993 Kamody ..... 62/65

*Primary Examiner*—Ronald Capossela

*Attorney, Agent, or Firm*—Armstrong, Westerman, Hattori, McLeland & Naughton

[57] ABSTRACT

A process for treating an article of metal containing material, the process in including subjecting the article to a deep cryogenic treatment at a temperature of −120° F. or lower, subjecting the article to at most a partial tempering treatment, and then nitriding a surface of the article so as to form nitrides near a surface of the article.

15 Claims, 5 Drawing Sheets

PROCESS OF NITRIDING METAL-CONTAINING MATERIALS

The present invention relates generally to processes for nitriding metal containing materials such as steels, and, more particularly, to nitriding processes wherein a deep cryogenic type treatment step is utilized followed by, at most, a partial tempering step before the nitriding is conducted so as to improve or enhance the surface hardness properties of the metal containing material while retaining the ductility properties of the remainder of the metal containing material.

While the processes of the subject invention will be discussed primarily hereinafter with reference to cryogenic processes which use liquid nitrogen as the cryogenic material for improving the properties of steel type materials prior to nitriding, it is to be understood that the use and the application of the process of the subject invention are not thereby so limited. For example, the processes of the invention may be useful in the treatment of many other metal containing materials not including iron, although their use in connection with iron containing materials is presently preferred. In addition, other cryogenic media may be utilized in the processes such as other liquified or solidified gases.

In the manufacture of tools and tool components, machinery, engine parts, wear surfaces and the like articles from various steels which are used for high wear applications, it is common practice to subject the steel to one or more treatments, either before or after formation of the steel carbide, so as to modify the properties of at least the exterior of the components and thereby provide the articles with a longer wear life and the like. A number of thermal type processes are known in the metallurgical arts to enhance the properties of metal containing materials such as steels. One widely used class of such metallurgical processes generally involve a heat treatment of the metal containing article, that is, elevating the temperature from ambient or from forming temperatures and then cooling. Another common class of enhancement processes is sometime known as quenching and typically involves forming an article of the desired metal containing material and then rapidly lowering the temperature of the article followed by a return of the article to ambient temperature. A combination of the two classes of treatment processes is often used.

A further enhancement process for metal containing materials such as steels is in the formation of a nitride containing layer on the surface of an article of the metal containing material which case hardens the material by forming nitrides such as metal nitrides at or near the surface of an article. The formed nitride surface layer may include extremely hard compounds containing nitrides such as CrN, $Fe_2N$, $Fe_3N$ and $Fe_4N$ in the case of a steel article which are formed uniformly and deeply from the surface of the article toward the inside thereof. This formed nitride layer tends to create compressive stresses which improve the properties of the metal containing material in terms of, for example, hardness and thus wear resistance, as well as corrosion resistance and fatigue strength possibly along with other mechanical properties such as anti-friction properties.

Various processes for nitriding articles of metal containing materials such as steel for the formation of a hard nitride layer onto the surface of the article have been employed. These nitriding processes include, among others, a process using a molten cyanate or cyanide salt such as NaCNO or KCN known as liquid nitriding; a glow discharge process sometimes termed as ionitriding or plasma nitriding process where nitriding is accomplished by means of glow discharge in an atmosphere of, for example, $N_2$ and $H_2$, under a high degree of vacuum; and a process using, for example, dissociated ammonia often times referred to as gas nitriding. An advantage of all of these nitriding processes is the lack of distortion during surface hardening, unlike quench hardening, which usually results in at least small changes in dimensions and, at worst, in distortions of the article being treated.

When the above nitriding processes are used in the surface hardening treatment of steels, for example, the nitriding processes require relatively high operating temperatures. Typically, liquid nitriding processes use temperatures ranging from 510 to 580° C. (950 to 1075° F.), plasma or ionitriding processes use temperatures ranging from 375 to 650° C. (705 to 1200° F.), and gas nitriding processes use temperatures ranging from 495 to 565° C. (925 to 1050° F.).

A precondition of a metal containing material such as steel prior to nitriding is that the steel must be a hardenable steel, and that the hardenable steel must be core hardened and tempered prior to conducting the nitriding process. This temper should be no lower than the nitriding temperature and preferably slightly higher, usually 10° C. (50° F.) higher. For example, tempering requirements for gas nitriding should be a temperature of at least 495° C.+100° C. (950° F.+50° F.), for liquid nitriding, required tempering temperatures should be a temperature of at least 510° C.+10° C. (950° F.+50° F.), and for plasma (ion) nitriding tempering requirements should be a temperature of at least 375° C.+10° C. (705° F.+50° F.).

In addition to the above tempering temperature requirements, the tempering time at the indicated temperature must be of a sufficiently long duration, usually at least one hour per one inch minimum cross section of the article being treated. In general, the tempering temperature and time should be adequate to create a stable microstructure in core hardening steels, one that has more tempered martensite and new formation of carbides during the tempering process. These requirements can be found in the current, up-dated version of the ASM International, Material Information Society, Heat Treater's Guide (Practices and Procedures for Irons and Steels, 2nd Edition 1995). In practice, based upon the chemistry of steel, the higher the carbon and/or alloy make-up of steel, the more time at temperature is required for tempering and multi-temper tempering procedures may be necessary to achieve a stable microstructure.

Generally, processes for the preparation of a core hardened steel article and then nitriding this article using any of the above nitriding procedures include the following sequence of treatments:

1. Provide machined or shaped article
2. Deep cryogenic freezing (optional)
3. Austenizing
4. Quenching
5. Stabilizing (optional)
   a. Snap tempering
   b. Cryogenic treating
      i. Deep cryogenic treating (−320° F.) or
      ii. Shallow cryogenic treating (−120° F.)
6. Full or complete tempering (may be multiple tempers)
7. Machining (optional)
8. Cleaning (optional but preferable)
9. Nitriding In the above treatment sequence, steps (3) through (6), particularly necessary steps (3), (4) and (6), together are generally termed "heat treating" or "hardening" for the steel article. This treatment sequence provides the core hardness necessary for the strength required of the article. More particularly, the austenizing step (3) of the sequence heats the article to a temperature sufficient to convert the ferrite structure contained in the steel of the article to an austenite structure without pronounced grain growth, typically by heating to a temperature in the range of 1800–2100° F. The primary purpose of the quenching step (4) typically cool the article to, for example, ambient temperature, and the primary purpose of the quenching step is to cool at a rate rapid enough to suppress all transformations at temperatures above the Ms temperature. The cooling rate required in the quenching depends upon the size of the article and the hardenability of the steel and the quenching period should be long enough to permit transformation to martensite.

The required tempering step (6) stabilizes the martensitic structure of the steel by relieving the high residual stress of the very hard and brittle martensite formed during quenching and thereby improves ductility of the article at the expense of some strength and hardness. Tempering may also tend to form carbides in the steel. Generally, the treatment temperature for the tempering step is, for example, up to about 1100° F. or more, and typically is greater than the treatment temperature for the austenizing step. In addition, conducting the tempering step at a temperature of at least 10° C. (50°) over the nitriding temperature tends to minimize distortion of the article.

In summary, a tempering step is considered to be an absolute requirement before effective nitriding can be achieved. If the tempering temperature is not high enough and/or if the tempering time at temperature is not long enough, and/or if multi-tempering is not performed, then the resultant effect of nitriding is a core hardened steel article which may crack, spall, chip, lose toughness, and/or lose hardness.

Further, it is to be noted that other factors may cause poor nitriding results as well. For example, the improper cleaning or poor surface condition of the core hardened and adequately tempered steel article may also cause the above cited problems. As another example, the actual chemistry of the steel may not have enough nitriding-making elements, such as carbon, or alloy to make effective results in nitriding. As a further example, the actual parameters of the nitriding process itself, if not maintained and/or calibrated in flow rates and/or pressure of the atomic nitrogen source and/or as well as other gases, in temperature levels as well as the difference of the different arts of nitriding, can also cause poor results as an outcome from nitriding.

In general nitriding has many dependent variables which, if not controlled, can downgrade the performance of a nitrided steel article during its application. If these dependent variables are well controlled, then the surface hardness will usually range between 53 HRC and 70 HRC (Hardness—Rockwell C) with a mean average approximately closer to 63 HRC, the effect of cracking, spalling, chipping, or loss of toughness can be reduced to a much lower level of frequency. Other nitriding enhancement techniques used are the inclusion of other element additives, such as titanium, and these other element additives can elevate hardness dramatically which can approach near diamond like hardness of 90 HRC. With these additives, as surface hardness increases the control issue of depth of hardness must be maintained to be very thin and considered to be much like a film or trace into the surface penetration. As surface hardness increases and as depth of penetration increases, then spalling, chipping, cracking or less and/or loss of toughness may result.

In any regard, as was stated above, conventional nitriding treatments for metal containing materials such as steels require that the materials be subjected to one or more tempering treatments prior to nitriding. As is apparent, such tempering treatments increase the processing time for nitriding an article of metal containing material and, as a consequence, may increase the processing costs for such an article.

Further, and perhaps more importantly, nitriding of an article of metal containing material, while providing the article with an advantageous increased surface hardness and thus improved wearability and the like, also tends to degrade certain properties of the article such as decreasing the ductility of the article. Thus, it would be desirable to utilize a nitriding treatment for a metal containing material so as to realize the benefits of an increased surface hardness yet while maintaining the ductility of the metal containing material prior to nitriding. Further, nitrided materials having a higher surface hardness as well as a higher case hardness profile are highly desirable.

SUMMARY OF THE INVENTION

It therefore is a feature of the subject invention to provide a process for the pretreatment of articles of metal containing material prior to nitriding which is conducted using a a cryogenic treatment with little or no tempering conducted subsequent to the cryogenic treatment.

It also is a feature of the subject invention to provide a process for the pretreatment of articles of metal containing material prior to nitriding which is conducted using a deep cryogenic treatment, which produces articles after nitriding having a high surface hardness yet with a decrease in embrittlement of the article being minimized or even eliminated.

It further is a feature of the subject invention to provide a process for the pretreatment of articles of metal containing material prior to nitriding which can be conducted at significantly less cost and/or less time than conventional treatment processes used prior to nitriding.

It is a further feature of the subject invention to provide a process including a pretreatment prior to nitriding of articles of metal containing material, particularly iron containing material such as steel, which produces articles having, among other things, improved properties such as enhanced wearability, lubricity and/or hardness while essentially retaining the ductility properties of the metal containing material such as iron containing material prior to nitriding.

It is yet another feature of the subject invention to provide a process for the pretreatment prior to nitriding of metal containing materials that is particularly adapted for the pretreatment of steels such as tool steels so as to provide articles of such tool steels with improved hardness combined with increased ductility and thus extended wearability in tool applications.

Briefly, the present invention comprehends in its broader aspects a process for treating an article of metal containing material, the process in including subjecting the article to a deep cryogenic treatment at a temperature of −120° F. or lower, subjecting the article to at most a partial tempering treatment, and then nitriding a surface of the article so as to form nitrides near a surface of the article. In another aspect of the present invention, contemplated are articles of metal containing material produced by the above process.

Further features, objects and advantages of the present invention will become more fully apparent from a detailed consideration of the arrangement of the steps and conditions of the subject processes as set forth in the following description when taken together with the accompanying drawings.

DETAILED DESCRIPTION OF THE PREFERRED EMBODIMENTS

Figure 1:
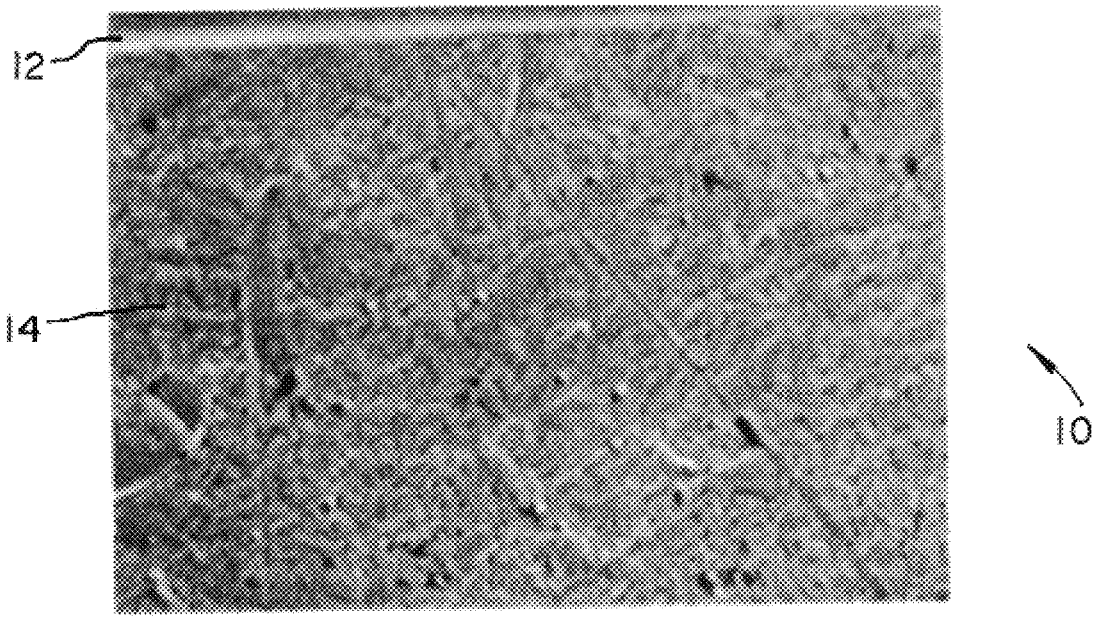
FIG. 1 is a photomicrograph of a nitrided H-13 steel produced by a conventional nitriding process which includes at least one tempering prior to nitriding, the photomicrograph being a 750× SEM.

As was previously mentioned, the subject invention is directed in one of its aspects to an improved nitriding process for the treatment of metal containing materials, and, more specifically, the subject invention is directed to a nitriding process wherein a metal containing material is first subjected to a deep cryogenic treatment, which is followed by no tempering or is followed by a brief or fractional temper, and then the material is nitrided such as by conventional nitriding procedures or techniques.

More particularly, the above step of subjecting the material to "deep" cryogenic treatment generally means lowering the temperature of the material to a cryogenic temperature of, for example, −120° F. or lower, preferably −320 to −330° F., which is at or near the temperature of liquid nitrogen, or lower. Such a treatment can be accomplished by utilizing any deep cryogenic treatment known in the cryogenic art. On the other hand, cold treatments such as mechanical refrigerators, dry ice treatments, or cold box technology that freeze a material such as steel with a so-called "shallow" treatment near or under −140° F. generally are not satisfactory for the purposes of the deep cryogenic treatment utilized in the present invention.

The ASM International provides a definition of cryogenic treatment as being at or near the temperature of liquid nitrogen (−327° F.) and a definition of cold treatment at less than liquid nitrogen temperature and generally no colder than −120° F. In the ASM International, Material Information Society, Heat Treaters Guide (Practices and Procedures of Irons and Steels $2^{nd}$ Edition 1995). In practice, many steels, after quench, have an optional stabilizing step before tempering. This optional stabilizing step is for the purpose of dimensional stability for intricate shapes and is to refrigerate at −100° C. to 195° C. (−150° F. to −320° F.). This freezing step is not to include any cold treatment.

The stabilization step can be utilized in the present invention as long as it does not include cold treatment. Stabilization which is not colder than −120° F.

As mentioned above, the deep cryogenic treatment used in the processes of the present invention can be any deep cryogenic treatment known in the cryogenic art. Presently preferred deep cryogenic treatments are those disclosed in U.S. Pat. No. 5,259,000 issued Nov. 9, 1993, to Dennis J. Kamody, and in U.S. Pat. No. 5,875,636 by Dennis J. Kamody, issued Mar. 2, 1999, both incorporated by reference herein in their entireties. Combinations of the cryogenic treatments disclosed in the patent and the application may be employed in the processes of the subject invention.

The cryogenic material used in the subject processes to lower the temperature of the article being treated to a deep cryogenic temperature can be selected from a variety of materials, the primary considerations in the selection being the temperature of the material and its availability and thus cost, and ease and safety in handling. Generally, cryogenic fluids such as liquified gases including liquid nitrogen and liquid oxygen are preferred for use as the cryogenic material. Other commercially significant cryogenic materials include liquified argon, helium and hydrogen. Liquid nitrogen is presently preferred due to its wide availability and low cost as well as its ease and safety in handling and favorable temperature (about −327° F.).

The container or vessel for the cryogenic material such as a cryogenic fluid used with the process may be of various constructions and designs of the type which are adapted to hold a bath of cryogenic material. Generally such containers are highly insulated and are constructed of materials which are non-reactive with the cryogenic material. The container may be open or may have a raisable top or lid.

Prior to the deep cryogenic treatment, it generally is beneficial to subject the article of metal containing material, particularly articles containing steel, to at least one of steps (2) through (4) set forth previously. That is, the article may be subjected to (2) an optional deep cryogenic freeze, (3) an austenizing treatment and (4) a quenching treatment.

More particularly, it has been found that it may be beneficial for net shaping of the article by including a deep cryogenic freezing step before the heat treatment of austenizing. The ASM recommends that annealed material can be subjected to cryogenic freezing thereby resulting in stress relief of the article. When there is a requirement of near net shaped parts that will have little variants in growth and shrinkage, this step of cryogenic freezing before austenizing preferably should be used.

In addition to the above, it may be beneficial to optionally stress relieve the article with a heat treatment, also known as a snap temper, before extending the quenching step to the range of −320° F. or lower in the deep cryogenic treatment. Such a stress relief is in accordance with the suggested ASM recommendation of utilizing an optional stabilizing step before any deep cryogenic freezing.

Following the deep cryogenic treatment, the article of metal containing material being treated in accordance with the process of the present invention may be subjected to one or more optional partial, but not complete, tempering treatments. In contrast, the ASM International standards mentioned previously do not state that tempering after stabilizing or after as quenched condition is optional. Any tempering treatment used in the processes of the present invention must be less than what is considered to be a complete tempering treatment or an adequate tempering treatment. The ASM International defines an "adequate" temper as one that given for the selected chemistry of the steel that at a given temperature and time at a temperature based upon cross sectional mass of the steel to achieve results.

Thus, for the purposes of the present invention, when tempering, this tempering treatment must be a partial tempering, that is, less than the recommended ASM standard. As a consequence, the chemistry of the steel, temperature, and time at temperature per cross section considerations are not used. Rather, the optional partial tempering fundamentally does not change or continue any further number of transformation of the structure of the metal containing material such as steel. The benefit, if the optional partial tempering treatment is utilized, is only for the purpose of providing a stress relief function of the metal containing material such as steel, and is not one which allows further structural transformation of the microstructure, such as, retained austenite reduction, newly formed martensite, tempering of martensite or decomposing martensite, or the creation of epsilon or eta-carbides.

Conventional nitriding processes all require that a metal containing material steel has to have undergone a complete transformation into a stable structural state before nitriding is performed. The processes of the present invention do meet this condition with the exception of either no or very little epsilon or eta-carbides are formed that normally would have been created during adequate tempering (excluding any residual carbides that may have been present as formed during the austenizing portion of the heat treatment). Thus, any partial tempering treatment conducted in the processes of the present invention is basically only to stress relieve the article and does forms little or no carbides which normally result from a one or more adequate tempering treatments as defined previously. These partial tempering treatments are similar to a snap temper where the article is only held for a brief time at a temperature above the Ms temperature as discussed above and are not an adequate temper as defined by ASM at time and temperature per cross-section of the material. Tempering temperatures above the Ms are also to be considered if for the purpose is for stress reliever.

Once the article of metal containing material has been subjected to the deep cryogenic treatment, and the optional partial tempering, both as described above, the article is then nitrided in accordance with the concepts of the present invention. The nitriding may be conducted utilizing any nitriding process including known nitriding processes. As set forth previously, such known nitriding processes include liquid nitriding processes using temperatures ranging from 510 to 580° C. (950 to 1075° F.), plasma or ionitriding processes using temperatures ranging from 375 to 650° C. (705 to 1200° F.), and gas nitriding processes using temperatures ranging from 495 to 565° C. (925 to 1050° F.).

Generally speaking, the metal containing material which can be advantageously treated by the processes according to the present invention may vary considerably and can include metallic elements, metal alloys and metal composites either alone or in combination with non-metallic materials such as ceramics, polymeric materials and the like. Suitable metals which may be included in the metal containing materials include iron, nickel, cobalt, copper, aluminum, refractory metals such as tungsten, molybdenum and titanium, combinations, alloys and composites thereof including carbide, nitride and boride containing materials and the like.

The processes of the invention have been found to be particularly advantageous for the treatment of iron containing materials including cast iron, sintered iron, iron alloys, iron containing composites as well as for various steels, particularly carbon steels, low alloy steels, nitriding steels, heat-resistant steels, high speed steels, stainless steels and tool steels. In the latter regard, various properties of steels such as tool steels used for forming, shaping or cutting materials such as metals, metallic composites, organic materials such as polymers and especially reinforced polymers, have been found to benefit from the processes of the present invention, particularly with regard to their hardness and/or resistance to wear. Such tool steels are oftentimes fabricated into tools such as drill bits, taps, cutters such as cutting blades, reamers, borers, dies such as punch dies, and the like. Other steels treated in accordance with the present invention may be used as extrusion cylinders, lead screws for machine tools, gears, spindles and the like.

The process of the invention also may be particularly advantageous for the treatment of materials known a cemented carbides such as those containing tungsten carbide. Certain classes of cemented carbides such as those known under the designations C1, C5 and C6 containing nickel and cobalt especially benefit in terms of improved shockability, wearability, stability and hardness by treatment. The processes of the present invention also find particular applicability to the treatment of articles of metal containing materials formed by powder metallurigical techniques.

For the purposes of illustration only, the subject processes are illustrated hereinafter with reference to a particularly preferred process in accordance with the present invention which includes the preparation of a core hardened steel article and then in nitriding this article. In this process, the steel article may be subjected to the following sequence of treatments:

A. Provide machined or shaped part
B. Deep cryogenic freezing (optional)
C. Austenizing
D. Quenching
E. Snap temper (optional)
F. Deep Cryogenic treating (−120° F. or lower)
G. Partial tempering (optional)
H. Machining (optional)
I. Cleaning (optional but preferable)
J. Nitriding In the above sequence of treatments, the recited steps have generally the same meanings as discussed previously with reference to sequence (1) through (9). The above snap tempering step is a heat treatment of the article up to or below the martensitic start (Ms) temperature of the steel. The ASM defines the Ms temperature for most types of steel.

Articles produced by the processes of the present invention are characterized as exhibiting improved properties such as ductility in comparison with articles produced according to conventional nitriding procedures. In addition, articles produced by the processes of the present invention exhibit significantly increased surface hardness in comparison with articles produced according to conventional nitriding procedures. Also, nitrided steel articles produced according to the processes of the invention may exhibit as many as five zones or layers of different structures existing from the outer surface toward the core of steel article. These structure an be easily differentiated or identified using optical measurement at 500× to 1000× power amplification by using a common laboratory microscope, by using a scanning electron microscope (SEM) at 500× to 15000× power amplification. Furthermore, articles produced by the processes of the present invention may show increased mechanical properties in terms of, for example, impact and tensile strength as well as increased wear resistance.

The processes of the present invention are illustrated by the following Example. It is to be understood that this Example is provided only for the purposes of illustration of the subject invention and is not to be considered limiting of the subject invention as has been described herein.

EXAMPLE

Two articles of H-13 alloy steel were nitrided, one article nitrided according to conventional procedures and a second article nitrided with a process according to the present invention.

Specifically, two articles of the above steel were placed in a neutral hardening atmospheric furnace, pre-heated and held at about 1550° F. for about one hour, and then austenized at about 1875° F. for about forty-five minutes. Thereafter, both articles were air quenched down to ambient temperature.

Article A to be nitrided by conventional procedures was then subjected to a first temper at about 1120° for about two hours followed by a second temper at about the same temperature for about the same period of time. In contrast, article B treated according to the process of the present invention was not tempered at all, but rather was subjected to a deep cryogenic treatment in liquid nitrogen until the article stabilized at the temperature of the liquid nitrogen.

Thereafter, both articles A and B were subjected to a surface conditioning and then washed. The surface conditioning for the tempered article treated according to conventional procedures was ground using a grinding tool. The surface conditioning for the article treated in accordance with the present invention was subjected to a glass bead blasting procedure.

Subsequently, both articles A and B were subjected to essentially the same nitriding procedure. Specifically, the articles were placed in a nitriding furnace adapted to use dissociated anhydrous ammonia for nitriding. The temperature of the furnace was increased from ambient temperature to about 970° F. over a four hour period and then gas nitriding was commenced at about that same temperature and continued for about eight hours in a first nitriding stage. Thereafter, the articles were nitrided for an additional four hours at about 1100° C. in a second nitriding stage and then cooled to ambient temperature over a four hour period.

Figure 2:
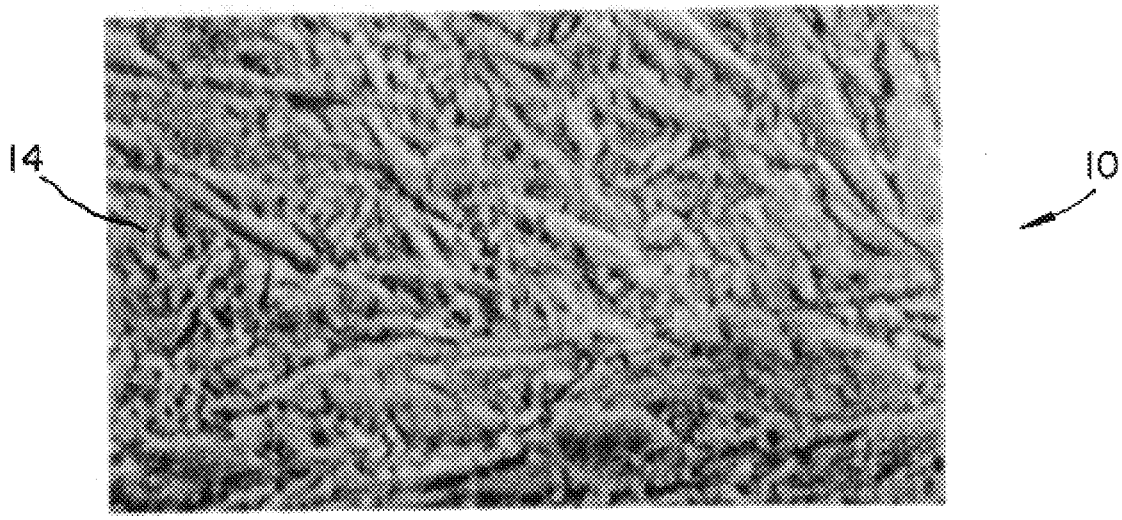
FIG. 2 is a photomicrograph of the same nitrided steel as shown in FIG. 1, the microphotograph being at 3000× by a SEM.

Each of the articles were then mounted, sliced and etched for examination by a scanning electron microscope (SEM). FIGS. 1 and 2 are photomicrographs which show the article A indicated as 10 which was nitrided according to conventional procedures, the former being at a magnification of 750 and the latter at a magnification of 3000. Of significance in these photomicrographs is that there is a clear separation or demarkation between the nitrided layer 12 and the core or substrate 14 of the article 10 as shown in FIG. 1, and, as a consequence, the hardness of the article immediately drops to essentially the core hardness inwardly of the nitrided layer. In addition, FIG. 2, which shows only the core or substrate 14 which is below or beneath the nitrided layer, exhibits no evidence of any nitrides being present in this portion of the article.

Figure 3:
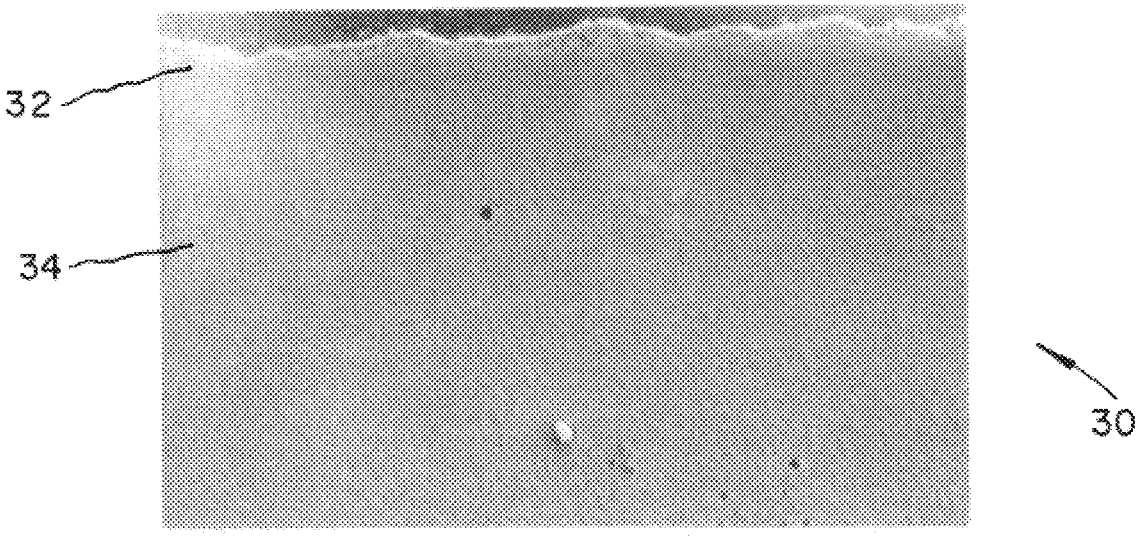
FIG. 3 is a photomicrograph of a nitrided H-13 steel produced by a process according to the present invention, the photomicrograph being at 750× by a SEM.
Figure 4:
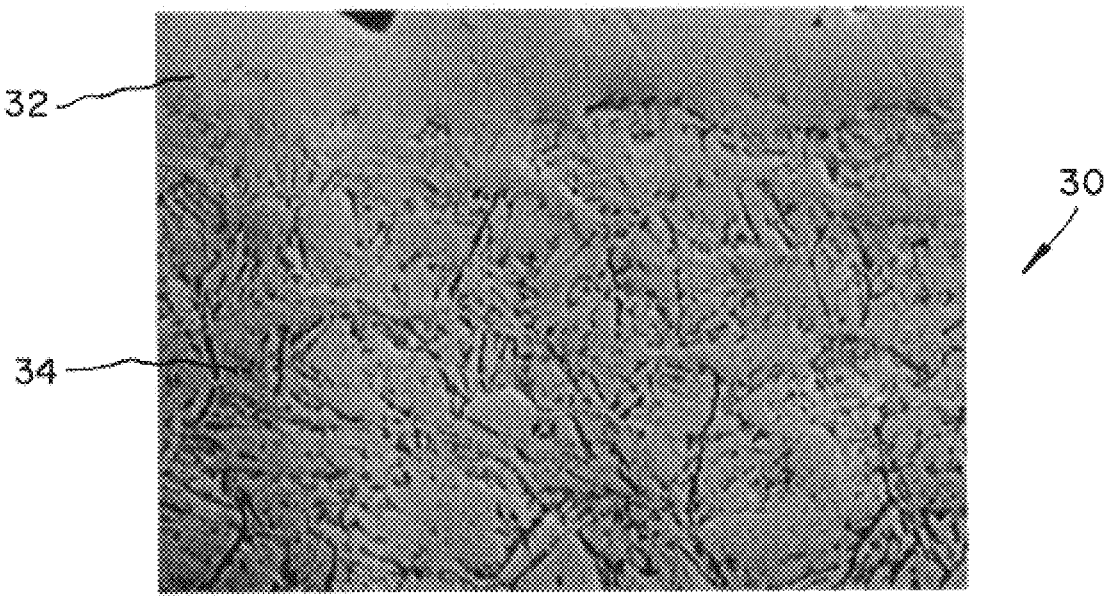
FIG. 4 is a microphotograph of the same nitrided steel as shown in FIG. 3, the photomicrograph being at 3000× by a SEM.

In contrast, FIGS. 3 through 6 are photomicrographs which show article B indicated as 30 which was nitrided according to a process in accordance with the present invention. These photomicrographs are at various magnifications ranging from of 500 in FIG. 3 and to a magnification of 12800 in FIG. 6. Of significance in the photomicrographs of FIGS. 3 and 4 is that there is a not clear separation or demarcation between the nitrided layer 32 and the core or substrate 34 of the article 30, and, as a consequence, the hardness of the article ramps to the core hardness inwardly of the nitrided layer. In addition, FIGS. 5 and 6, which show only the core or substrate 34 which is below or beneath the nitrided layer, exhibit evidence of nitrides being present in this portion of the article 30.

Figure 5:
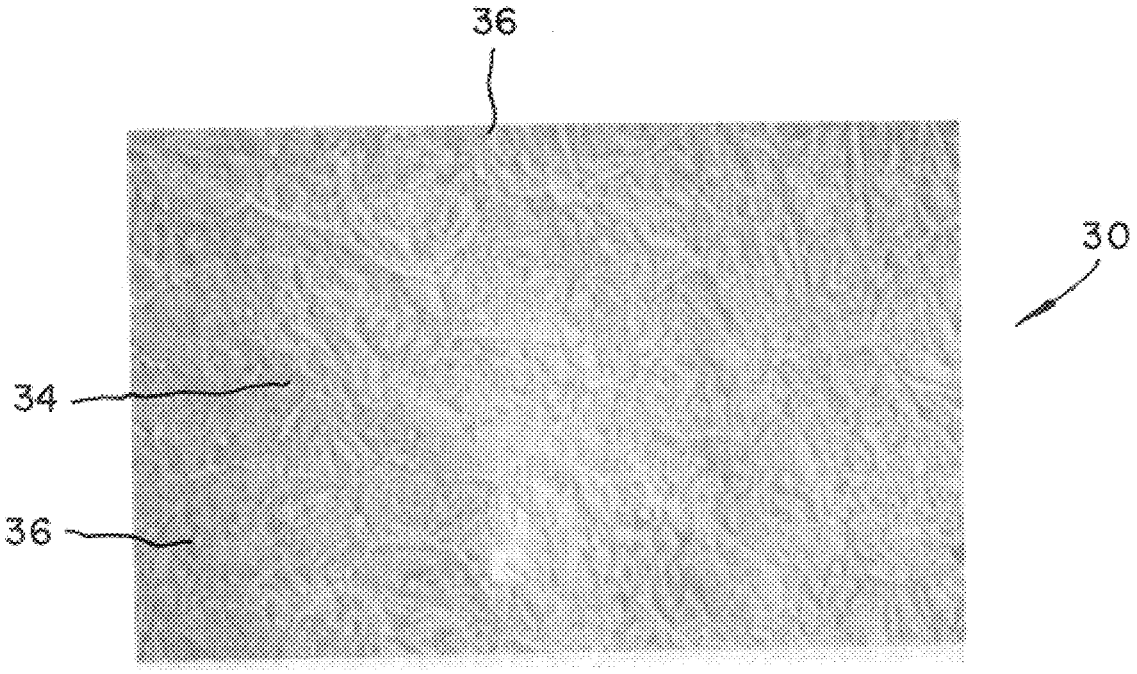
FIG. 5 is a photomicrograph of the same nitrided steel as shown in FIG. 3, the photomicrograph being at 3000× by a SEM.
Figure 6:
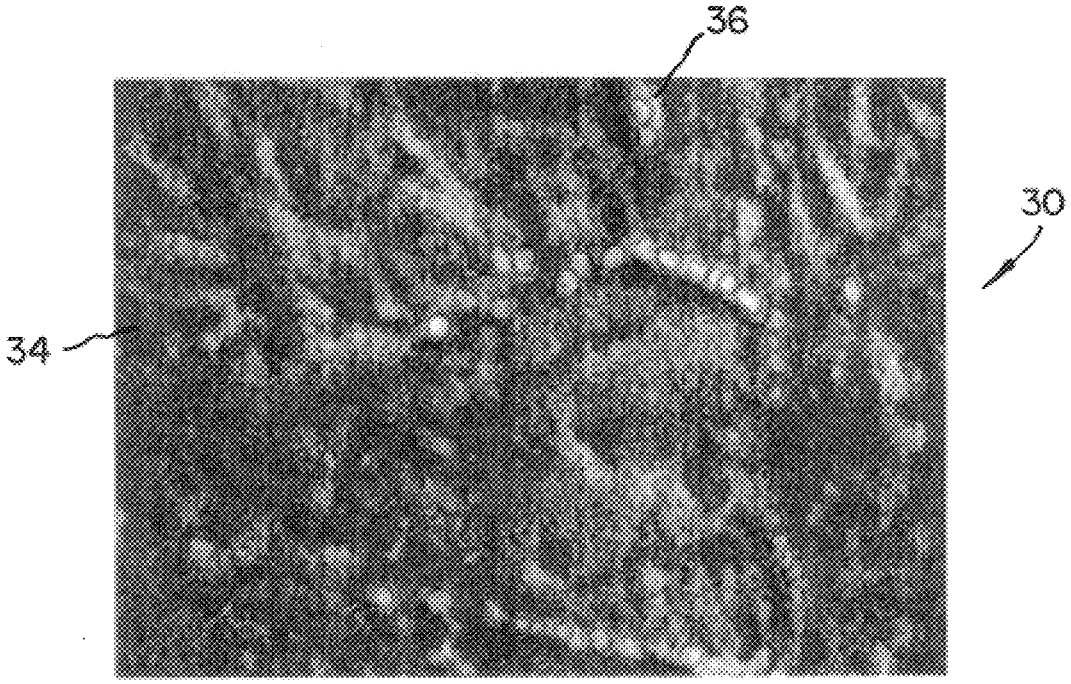
FIG. 6 is a photomicrograph of the same nitrided steel as shown in FIG. 3, the photomicrograph being at 3000× by a SEM.

Also of significance from FIGS. 5 and 6 is the presence of small round, globule-like structures 36 contained in core 34. As can be observed from FIG. 6, these structures 36 present an elevated appearance suggesting that the etching of the article 30 did not significantly affect these structures and thus that these structures have a very high hardness, perhaps a hardness higher than the nitrides contained therein. Further, it is possible that the round, ball-like shape of structures 36 contribute to the increased ductility of core 34.

As indicated previously, article 10 was ground to a good surface condition after nitriding whereas article 30 was only subjected to a glass bead blasting surface treatment. Consequently, article 10 as shown in FIG. 1 shows a straight line surface uniformity on the nitrided edge while article 30 as shown in FIGS. 3 and 4 exhibits a wavy or irregular nitrided edge profile for the article surface. If article 30 had been ground in the manner for article 10, the two articles would have generally the same surface profile.

Figure 7:
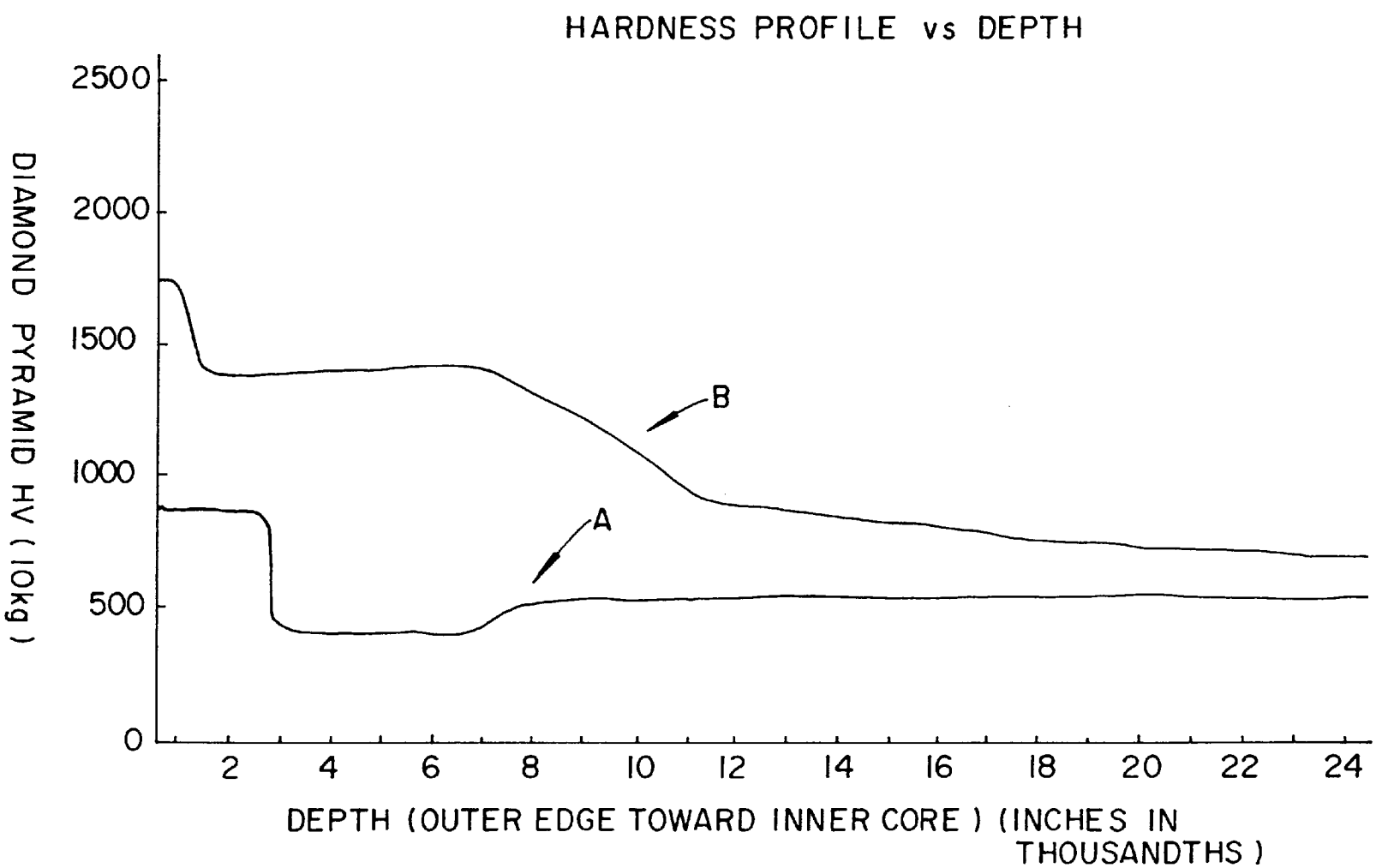
FIG. 7 is a graph of hardness versus depth from the surface of the two steel materials illustrated in FIGS. 1–6.
Figure 8:
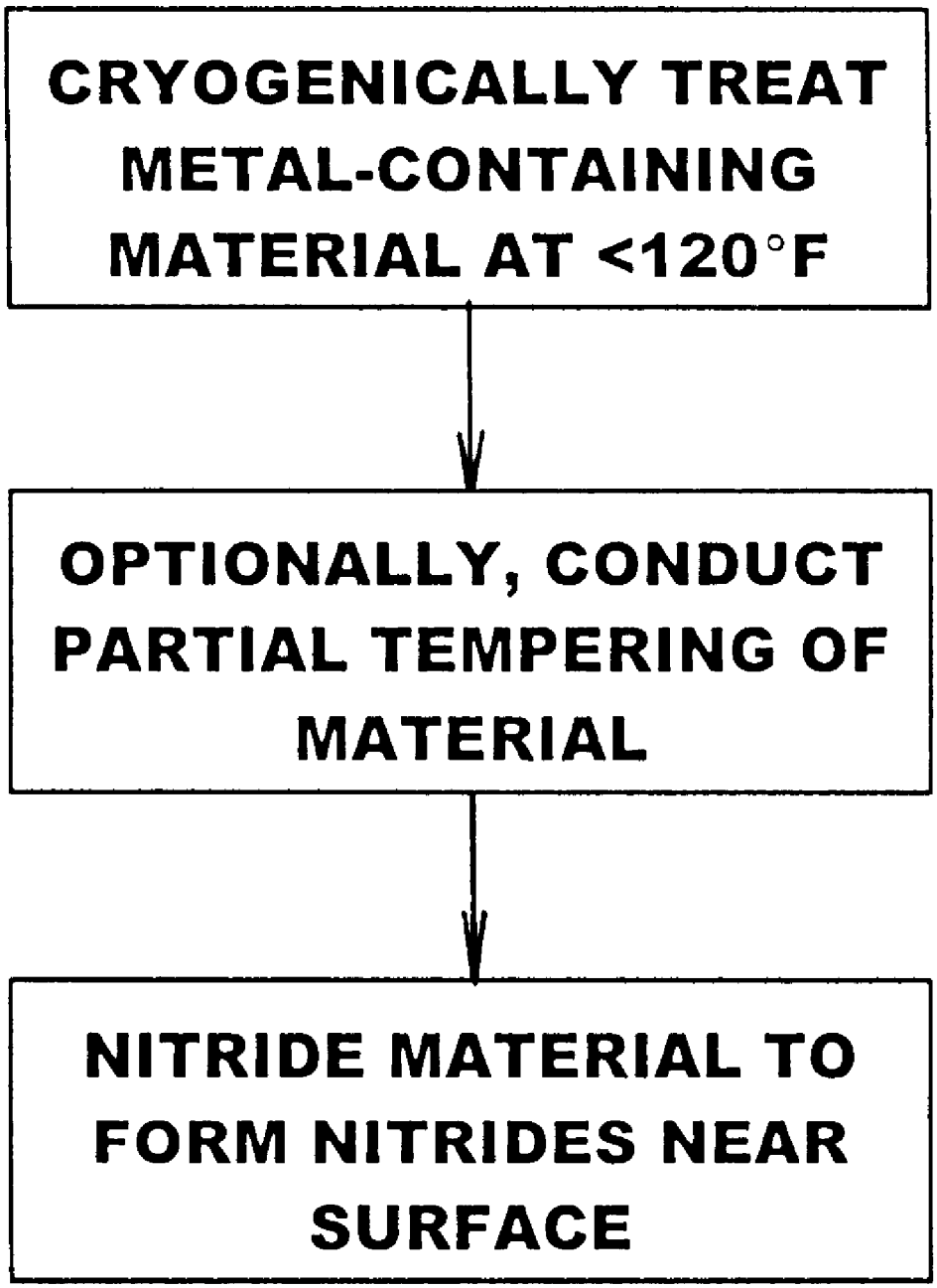
FIG. 8 is a block diagram illustrating steps according to the process of the present invention.

Articles 10 and 30 then were tested for hardness from the outer nitrided surface inwardly to obtain a hardness profile relative to depth for each article. The results are shown in FIG. 7 where plot A is for article 10 produced according to conventional procedures and plot B is for article 30 produced in accordance with the present invention. The abscissa of the Figure is depth from the surface of the article in thousandths of an inch and the ordinate is Vickers Hardness.

As is apparent from a consideration of the two plots contained in FIG. 7, article 30 exhibits in plot B a higher hardness across the entire depth profile as compared with article 10 shown in plot A. Of particular significance is that the hardness at or near the working surface for article 30 is considerably higher than the hardness for article 10. Further, article 30 exhibits a less steep rampdown in hardness with increasing depth from the surface of the article. Also, article 30 shows no evidence of a depletion zone of reduced hardness as exhibited by article 10 at a depth of about 3 to 7 units below the surface. From the hardness profiles shown in FIG. 7, it would appear that article 30 has up to five zones of differing structure whereas article 10 appears to only exhibit three distinct zones of differing structures as evidenced by the hardness of the above-mentioned depleted zone and differing hardness zones on either side of the depleted zone.

The reasons for the different hardness characteristics as well as the differences in microstructure between articles A and B as described above are not entirely understood. However, it is theorized that the deep cryogenic treatment without an adequate or complete tempering prior to nitriding tends to either maintain or create openings for aggressive penetration of atomic nitrogen thereby allowing for greater nitriding effects within the article. As a consequence, nitriding can proceed more quickly than in conventional nitriding, thus reducing the time necessary for the nitriding procedure and also allowing the depth of primary nitriding of an article to be more easily controlled.

As used herein, the term "deep cryogenic treatment" generally refers to the use of a temperature at or below about −120° F., generally below about −320° F., and typically on the order of about −327° F. or below. The term "ambient temperature" generally refers to a temperature of the external air about article to be treated and can vary from about 0°

F. to about 100° F. and includes room temperature. The term is intended to encompass those normal temperatures encountered by an article of metal containing material during processing in a manufacturing facility and thus can include temperatures corresponding to the external environment, e.g., the outside environment, in which the articles typically may be processed or stored. The term "room temperature" generally refers to the temperature at which buildings and the like are maintained for human habitation and typically is about 70° F. The phrase "minimum dimension" as applied to a three dimensional article means the smallest dimension in the x, y or z axis.

While there has been shown and described what are considered to be preferred embodiments of the present invention, it will be apparent to those skilled in the art to which the invention pertains that various changes and modifications may be made therein without departing from the invention as defined in the appended claims.

It is claimed:

1. A process for treating an article of metal containing material, the process comprising subjecting the article to a deep cryogenic treatment at a temperature of −120° F. or lower, and then nitriding a surface of the article so as to form nitrides near a surface of the article.

2. The process of claim 1, wherein a partial tempering treatment is conducted between the deep cryogenic treatment and nitriding.

3. The process of claim 1, wherein the metal containing material of the article includes steel.

4. The process of claim 3, wherein a partial tempering treatment is conducted between the deep cryogenic treatment and nitriding.

5. The process of claim 3 further including, prior to the deep cryogenic treatment, the steps of austenizing and quenching the article.

6. The process of claim 5, wherein a partial tempering treatment is conducted between the deep cryogenic treatment and nitriding.

7. The process of claim 3, wherein a partial tempering treatment is conducted.

8. The process of claim 7 further including, prior to the deep cryogenic treatment, the steps of austenizing and quenching the article.

9. The process of claim 8, wherein a snap tempering treatment is conducted prior to the deep cryogenic treatment.

10. The process of claim 9 wherein the immersion into the cryogenic fluid is discontinuous comprising partially immersing the article into the cryogenic fluid, followed by at least one hold step followed by a further partial immersion of the article into the cryogenic fluid.

11. An article produced by the process according to claim 8.

12. The process of claim 1 wherein the deep cryogenic treatment comprises providing the article at ambient temperature or below, completely immersing the article in a cryogenic fluid over a time period at least equal to 10 minutes times a value of a minimum cross-sectional dimension in inches of the article, withdrawing the article from contact with the cryogenic fluid, and immediately subjecting the article to a flow of gaseous fluid sufficient to raise the temperature of the article until the article reaches ambient temperature.

13. The process of claim 12 wherein the cryogenic fluid includes liquid nitrogen.

14. An article produced by the process according to claim 1.

15. The article of claim 14 wherein the metal containing material of the article includes steel.

* * * * *